US011092096B1

(12) United States Patent
Sun et al.

(10) Patent No.: US 11,092,096 B1
(45) Date of Patent: Aug. 17, 2021

(54) METHOD OF ESTIMATING OXYGEN STORAGE CAPACITY OF CATALYST

(71) Applicant: GM GLOBAL TECHNOLOGY OPERATIONS LLC, Detroit, MI (US)

(72) Inventors: Min Sun, Troy, MI (US); Jonathan M. Davis, Farmington Hills, MI (US); Andrew M. Fedewa, Clarkston, MI (US); Scott H. Wittkopp, Ypsilanti, MI (US); Brandon Bishop, Novi, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/009,824

(22) Filed: Sep. 2, 2020

(51) Int. Cl.
*F02D 41/14* (2006.01)
*F02D 41/02* (2006.01)

(52) U.S. Cl.
CPC ..... *F02D 41/0295* (2013.01); *F02D 41/1401* (2013.01); *F02D 41/1454* (2013.01); *F02D 2041/147* (2013.01); *F02D 2041/1416* (2013.01); *F02D 2041/1417* (2013.01); *F02D 2200/04* (2013.01); *F02D 2200/06* (2013.01); *F02D 2200/0802* (2013.01); *F02D 2200/0816* (2013.01); *F02D 2200/101* (2013.01)

(58) Field of Classification Search
CPC ..... F02D 41/02; F02D 41/0295; F02D 41/141401; F02D 41/1454; F02D 2200/0814; F02D 2200/0816; F01N 3/101; G01M 3/26
USPC ..... 701/101–105, 108, 114; 60/274–323
See application file for complete search history.

(56) References Cited

U.S. PATENT DOCUMENTS 6,782,695 B2 * 8/2004 Lutz ..... F01N 11/007 60/285
2005/0267669 A1 * 12/2005 Wang ..... F02D 41/1456 701/102
2010/0326052 A1 * 12/2010 Sun ..... B01D 53/90 60/274
2014/0208718 A1 * 7/2014 Chu ..... F01N 11/007 60/274
2015/0139860 A1 * 5/2015 Devarakonda ..... F01N 11/007 422/119
2018/0266354 A1 * 9/2018 Landolsi ..... F02D 41/18

* cited by examiner

*Primary Examiner* — John Kwon
*Assistant Examiner* — Johnny H Hoang

(57) ABSTRACT

An engine system for a vehicle includes an internal combustion engine having an exhaust gas outlet, an exhaust system having a three-way catalyst and a switch-type post oxygen sensor, and an engine control module that controls the engine system. The engine control module includes a first control logic for estimating a three-way catalyst oxygen storage capacity based on a plurality of measured inputs, a second control logic for estimating aging effects of the switch-type post oxygen sensor, and a third control logic that calculates a filtered estimated three-way catalyst oxygen storage capacity for the three-way catalyst.

20 Claims, 4 Drawing Sheets

METHOD OF ESTIMATING OXYGEN STORAGE CAPACITY OF CATALYST

INTRODUCTION

The present disclosure relates generally to a method of estimating the oxygen storage capacity of a catalyst of a catalytic converter for an internal combustion engine of a vehicle.

The ability to accurately estimate the oxygen storage capacity of a three-way catalyst results in increased fuel savings for an internal combustion engine. Current methods of estimation of oxygen storage capacity utilizing fuel cut off during a deceleration maneuver does not provide an accurate enough estimation to allow for more aggressive fuel strategy that provides such fuel savings. As a result, a new method of estimating oxygen storage capacity is required to achieve significant fuel saving without adding hardware to the engine system.

In addition, the catalyst must work properly and at a certain capacity to effectively reduce emissions and to pass vehicle regulations. Monitoring of the catalyst's ability to function accomplishes this objective.

Accordingly, there is a need for a new method of estimating oxygen storage capacity for effective fuel strategy for increased fuel efficiency and monitoring of its ability to function without adding additional cost in vehicle hardware.

SUMMARY

In an exemplary aspect, an engine system for a vehicle includes an internal combustion engine having an exhaust gas outlet, an exhaust system having a three-way catalyst and a switch-type post oxygen sensor, and an engine control module having a control logic sequence that includes a first control logic for estimating a three-way catalyst oxygen storage capacity based on a plurality of measured inputs using:

$$\frac{d\delta}{dt} = k^f\left(([CO] + [H_2] - 2[O_2])(1 - \mathrm{abs}(\delta)) - k^b\delta\right)$$

where [CO], [H2], and [O2] are CO, H2, and O2 concentrations at the three-way catalyst outlet and $K^f$ and $K^b$ are calibration constants; a second control logic for estimating aging effects of the switch-type post oxygen sensor, and a third control logic that calculates a filtered estimated three-way catalyst oxygen storage capacity for the three-way catalyst.

In another exemplary aspect, the control logic sequence further comprises a fourth control logic configured to control the internal combustion engine based upon the filtered estimated three-way catalyst oxygen storage capacity.

In another exemplary aspect, the second control logic estimates aging effects of the switch-type post oxygen sensor using:

$$\tau_\lambda \frac{d\delta_\tau}{dt} = \delta - \delta_\tau.$$

Where $\tau_A$ is switch-type post oxygen sensor dynamic response time

In another exemplary aspect, the first control logic estimates the three-way catalyst oxygen storage capacity by normalizing using: $(-1 \le \delta_\tau \le 1)$.

In another exemplary aspect, the control logic sequence further includes a control logic that determines the switch-type post oxygen sensor dynamic response time by integrating a rich-to-lean and a lean-to-rich response of the switch-type post oxygen sensor.

In another exemplary aspect, the first control logic further determines an estimated switch-type post oxygen sensor voltage using:

$$V_\lambda = f(\delta_\tau); (0 \le V_\lambda \le V_{\lambda_{max}}).$$

In another exemplary aspect, the plurality of measured inputs include at least one of a pre-catalyst equivalence ratio, a fuel flow rate, exhaust gas pressure, a pre-catalyst exhaust gas temperature, oxygen sensor voltage, a metered mass air flow value, an engine speed value, a catalyst temperature and a fuel control state value.

The above features and advantages and other features and advantages of the present disclosure are readily apparent from the following detailed description when taken in connection with the accompanying drawings.

BRIEF DESCRIPTION OF THE DRAWING

The drawings described herein are for illustration purposes only and are not intended to limit the scope of the present disclosure in any way.

DESCRIPTION

The following description is merely exemplary in nature and is not intended to limit the present disclosure, application, or uses. The term "about" as used in the description is defined as an amount around a specific number that does not have a significant impact on the results of the operation.

Figure 1:
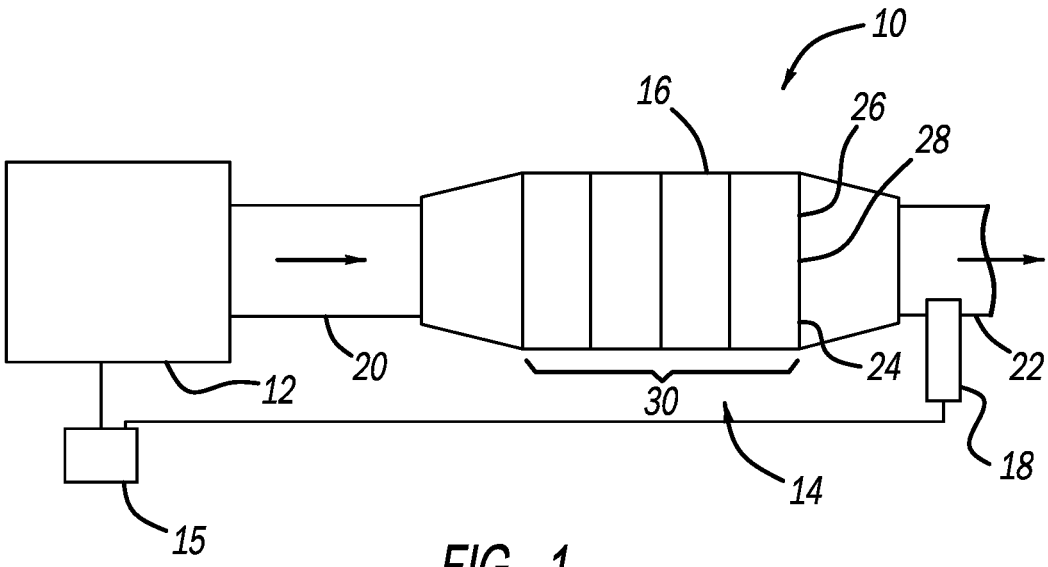
FIG. 1 is a schematic of an exemplary engine system in accordance with the present disclosure.
Figure 2:
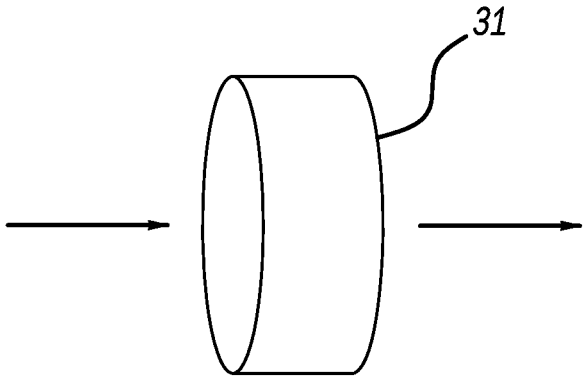
FIG. 2 illustrates a one-dimensional portion of a three-way catalyst in the system of FIG. 1.

Referring to FIGS. 1 and 2, a schematic for an engine system 10 for a vehicle is illustrated and will now be described. The engine system 10 includes an internal combustion engine (ICE) 12, an exhaust system 14, and an engine control module 15. The exhaust system 14 includes a catalyst assembly 16 and an oxygen sensor 18. More particularly, the catalyst assembly 16 has an exhaust gas inlet 20 and an exhaust gas outlet 22, and a three-way catalyst 24. The oxygen sensor 18 is disposed in the exhaust gas outlet 22 and may be a switch-type post oxygen sensor. The exhaust gas inlet 20 receives exhaust gas from the ICE and directs the exhaust gas to the three-way catalyst 24. The three-way catalyst 24 includes a ceramic substrate 26 on which is disposed a catalytic metal coating 28. In the present example, the catalytic metal coating 28 includes Cerium Oxide ($Ce_2O_3$). However, other metal oxides or combinations of metal oxides may be incorporated into the three-way catalyst 24 without departing from the scope of the present disclosure. For example, the catalytic metal coating 28 may include oxides of Rhodium (Rh), Palladium (Pd), and Platinum (Pt) among other metal oxides.

The engine control module 15 is preferably an electronic control device having a preprogrammed digital computer or processor, control logic, memory used to store data, and at least one I/O peripheral. The control logic includes a plurality of logic routines for monitoring, manipulating, and generating data. The engine control module 15 controls the plurality of actuators, pumps, valves, and other devices associated with the engine system 10 control according to the principles of the present disclosure. The control logic may be implemented in hardware, software, or a combination of hardware and software. For example, control logic may be in the form of program code that is stored on the electronic memory storage and executable by the processor. The engine control module 15 receives the output signal of each of several sensors on the vehicle, performs the control logic and sends command signals to several control devices. For example, a control logic implemented in software program code that is executable by the processor of the engine control module 15 includes a control logic for implementing a method described further below.

The present disclosure provides an improvement upon a three-way catalyst oxygen storage capacity real-time observer that is described in co-pending, co-assigned U.S. patent application Ser. No. 16/560,361 the disclosure of which is hereby incorporated by reference in its entirety. The three-way catalyst oxygen storage models described in U.S. patent application Ser. No. 16/560,361 may also be used together with the implementation of the present disclosure.

For the purposes of the present disclosure, the three-way catalyst is virtually separated into a plurality of segments 30. One such segment 31, is shown in FIG. 2 and represents a one-dimensional portion through which the catalytic reactions occur. The constituents of the exhaust gas going into the segment includes $[O_2]_{in}$, $[CO]_{in}$, $[CO_2]_{in}$, $[H_2]_{in}$, and $[H_2O]_{in}$ at an incoming gas temperature $T_{gin}$. After the catalytic reaction, the treated gas coming out of the segment includes $[O_2]_{out}$, $[CO]_{out}$, $[CO_2]_{out}$, $[H_2]_{out}$, and $[H_2O]_{out}$ at an outgoing gas temperature $T_{gout}$. For example, a first catalytic reaction is an Oxygen storage reaction represented by the following:

$$O_2 + 2Ce_2O_3 \leftrightarrow 2Ce_2O_4;$$

$$r_1 = k_1^f OSC^2(1-\varphi_{O_2})^2[O_2] - k_1^b OSC^2 \varphi_{O_2}{}^2 C_0;$$

$$k_1^f = A_1^f e^{-\frac{E_1^f}{T}}, \text{ and}$$

$$k_1^b = A_1^b e^{-\frac{E_1^b}{T}}.$$

A second catalytic reaction is a Carbon Monoxide Oxidation reaction represented by the following:

$$CO + Ce_2O_4 \leftrightarrow CO_2 + Ce_2O_3;$$

$$r_2 = k_2^f OSC\varphi_{O_2}[CO] - k_2^b OSC(1-\varphi_{O_2})[CO_2];$$

$$k_2^f = A_2^f e^{-\frac{E_2^f}{T}}, \text{ and}$$

-continued $$k_2^b = A_2^b e^{-\frac{E_2^b}{T}}.$$

A third catalytic reaction is a Hydrogen Oxidation reaction represented by the following:

$$H_2 + Ce_2O_4 \leftrightarrow H_2O + Ce_2O_3;$$

$$r_3 = k_3^f OSC\varphi_{O_2}[H_2] - k_3^b(1-\varphi_{O_2})[H_2O];$$

$$k_3^f = A_3^f e^{-\frac{E_3^f}{T}}, \text{ and}$$

$$k_3^b = A_3^b e^{-\frac{E_3^b}{T}}.$$

Oxygen storage value (OSV) is calculated using the following equation, where OSC is the oxygen storage capacity:

$$OSC\frac{\partial \varphi 0_2}{\partial t} = 2r_1 - r_2 - r_3.$$

The treated exhaust gas constituents coming out of the catalyst segment are calculated as follows:

$$[O_2]_{out} = \frac{[O_2]_{in} + k_1^b OSC^2 \varphi_{O_2}{}^2 C_O t_r}{1 + k_1^f OSC^2(1-\varphi_{O_2})^2 t_r}$$

$$[CO]_{out} = \frac{[CO]_{in} + ([CO]_{in} + [CO_2]_{in})k_2^b OSC(1-\varphi_{O_2})t_r}{1 + k_2^b OSC(1-\varphi_{O_2})^2 t_r + k_2^f OSC_{\varphi_{O_2}} t_r}$$

$$[CO_2]_{out} = \frac{[CO_2]_{in} + ([CO]_{in} + [CO_2]_{in})k_2^b OSC(1-\varphi_{O_2})t_r}{1 + k_2^b OSC(1-\varphi_{O_2})t_r + k_2^f OSC_{\varphi_{O_2}} t_r}$$

$$[H_2]_{out} = \frac{[H_2]_{in} + ([H_2]_{in} + [H_2O]_{in})k_3^b OSC(1-\varphi_{O_2})t_r}{1 + k_3^b OSC(1-\varphi_{O_2})t_r + k_3^f OSC_{\varphi_{O_2}} t_r}$$

$$[H_2O]_{out} = \frac{[H_2O]_{in} + ([CO]_{in} + [CO_2]_{in})k_3^f OSC(1-\varphi_{O_2})t_r}{1 + k_3^b OSC(1-\varphi_{O_2})t_r + k_3^f OSC_{\varphi_{O_2}} t_r}$$

Figure 3:
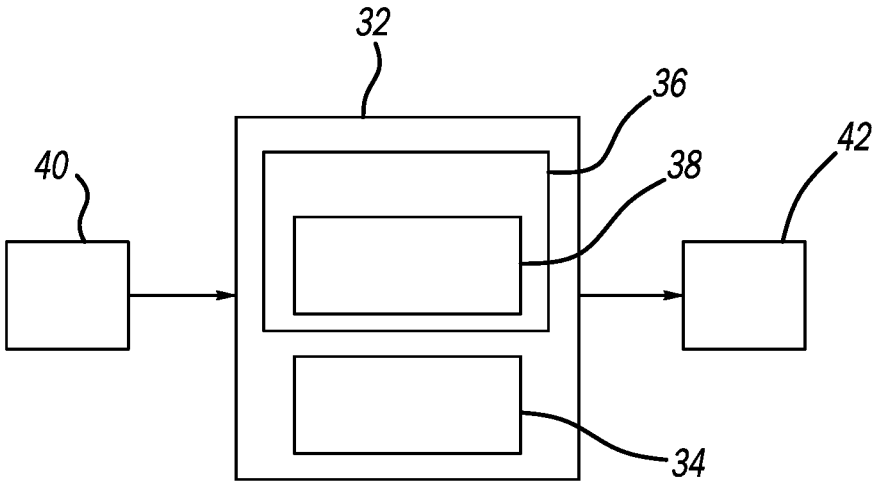
FIG. 3 is a schematic representation of an exemplary three-way catalyst observer model in accordance with the present disclosure.

Turning now to FIG. 3, a three-way catalyst observer model 32 is illustrated and will now be described. The three-way catalyst observer model 32 includes a Kalman filter 34 and a three-way catalyst kinetic model 36. The three-way catalyst kinetic model 36 includes a switch-type post lambda sensor model 38. Inputs 40 into the three-way catalyst observer model 32 include, for example, a pre-catalyst equivalence ratio, a fuel flow rate, exhaust gas pressure, a pre-catalyst exhaust gas temperature, oxygen sensor 18 voltage, a mass air flow value, an engine speed value, a catalyst temperature and a fuel control state value. Outputs 42 of the three-way catalyst observer model 32 include an oxygen storage value (OSV), a post-catalyst equivalence ratio (EQR), a post-catalyst switch voltage, an oxygen storage capacity (OSC), and a pre-catalyst EQR offset.

Figure 4:
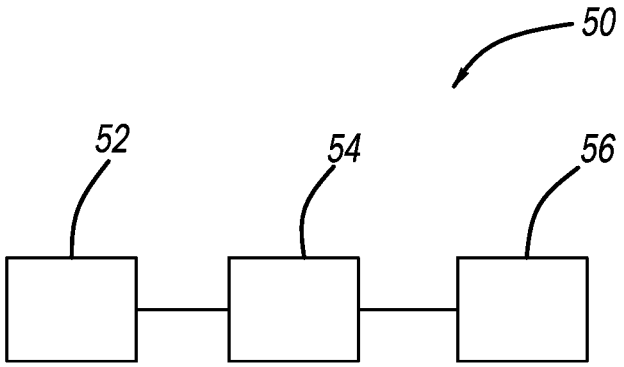
FIG. 4 is an exemplary flowchart illustrating a method in accordance with the present disclosure.

Turning now to FIG. 4 with continuing reference to FIG. 3, a flowchart is illustrated for a method 50 of dynamically estimating the OSC of the three-way catalyst 24. The method 50 includes a first step 52 of determining oxygen ion responsiveness to exhaust gases species with a normalized variable to represent oxygen ion concentrations in the sensor and while estimating aging effects on the sensor using:

$$\frac{d\delta}{dt} = k^f\left(([CO] + [H_2] - 2[O_2])(1 - \text{abs}(\delta)) - k^b\delta\right); (-1 \le \delta \le 1)$$

$$\tau_\lambda \frac{d\delta_\tau}{dt} = \delta - \delta_\tau; (-1 \le \delta_\tau \le 1)$$

Where $\tau_\lambda$ is switch-type post oxygen sensor dynamic response time

Where [CO], [H2], and [O2] are CO, H2, and O2 concentrations at the three-way catalyst outlet using a three-way catalyst model (an example of which is described previously) and $K^f$ and $K^b$ are calibration constants.

The method 50 continues to step 54 where the switch-type lambda sensor output voltage is estimated using:

$$V_\lambda = f(\delta_\tau);\ (0 \le V_\lambda \le V_{\lambda_{max}})$$

The method 50 then continues to step 56 where the observer uses a Kalman filter to correct the estimated oxygen storage and then calculates the three-way catalyst oxygen storage capacity.

Figure 5:
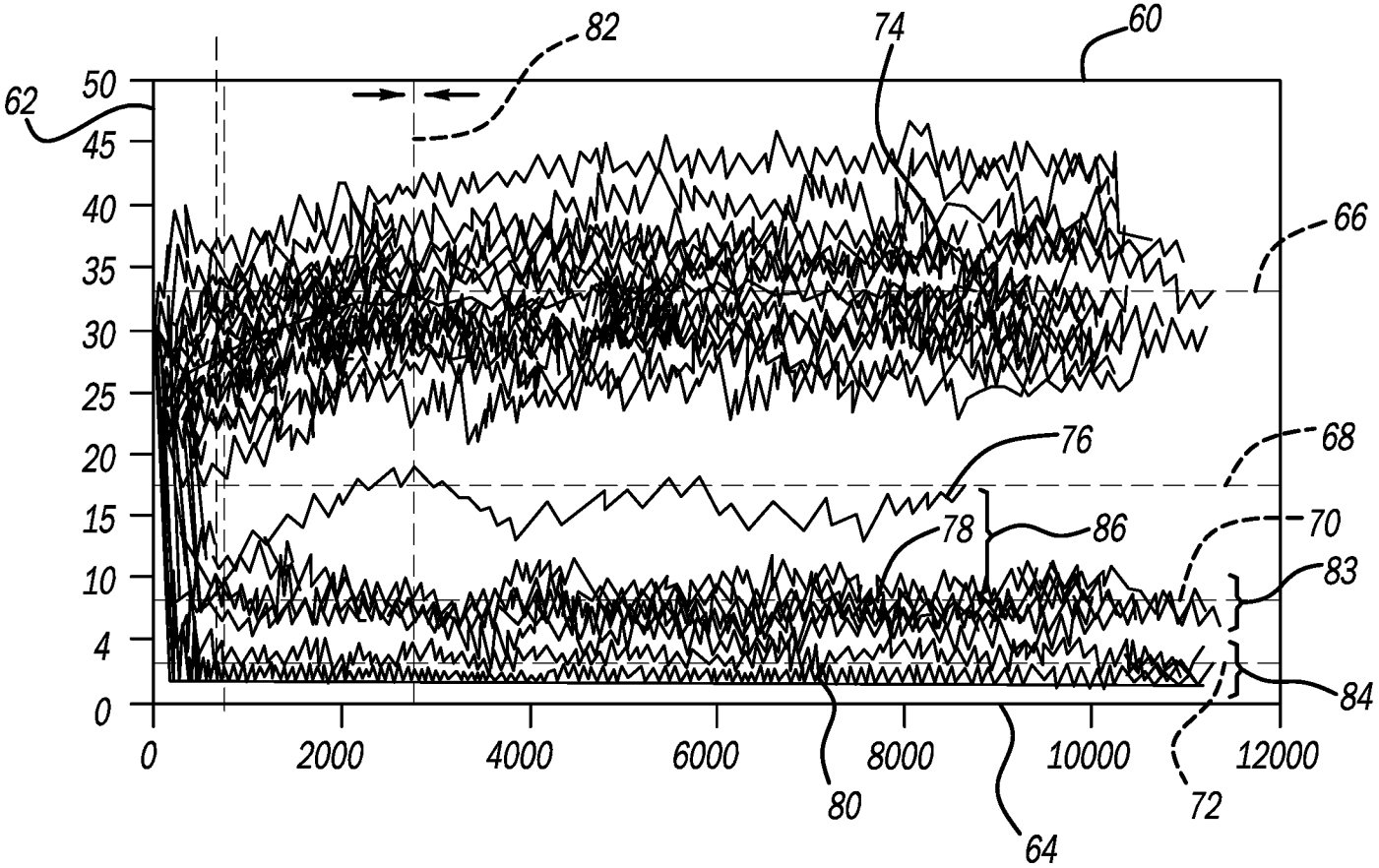
FIG. 5 is a graph illustrating an exemplary performance of a three-way catalyst observer in an engine system in accordance with the present disclosure.

With reference to FIG. 5, a graph 60 depicting the performance of the three-way catalyst observer model 32 and method 50 is illustrated and will now be described. The graph 60 includes a y-axis 62 depicting the estimated OSC over time 64 in seconds (x-axis). The dashed reference lines represent Worst Performing Acceptable (WPA) mean 66, WPA −4σ 68, Best Performing Unacceptable (BPU) +2σ 70 (70 is for BPU with a WPA post O2 sensor), and BPU mean 72. The performance lines represent calculated time-based WPA mean 74, time-based WPA −4σ 76, time-based BPU +2σ 78, and time-based BPU mean 80. The vertical dashed line represents the equivalent time of two Federal Test Procedure (FTP) cycles 82. The several lines contained by the bracket 83 represent the WPA degraded post oxygen sensor. The several lines contained by the bracket 84 represent the non-degraded post oxygen sensor. The bracket 86 represents the difference between the WPA −4σ and BPU +2σ.

Estimated OSV is used to determine fuel strategy. For example, when estimated OSV is low, a lean fuel strategy (air/fuel ratio is less than stoichiometric) is incorporated to introduce less fuel into the engine. Less fuel requires less Oxygen to burn the fuel leaving more Oxygen to store in the catalyst. Alternatively, stoichiometric and rich air/fuel ratio leaves less Oxygen available to store in the catalyst and therefore the oxidation of CO and H2 in the catalyst depletes the Oxygen storage of the catalyst. Current fuel strategies do not have the input of an accurate OSV estimation and therefore are required to assume OSV is low and requires more Oxygen to increase storage leading to reduced engine performance and higher fuel consumption. The capability to have a more accurate OSV estimation allows engine calibration to more accurately determine when the catalyst requires Oxygen to increase OSV and therefore run a fuel strategy more tailored to engine performance and other parameters that fuel strategy is used to control.

The oxygen storage capacity of the catalyst 24 is an indicator of the ability of the catalyst to effectively reduce emissions. For example, if the catalyst has aged to a significant extent, the oxygen storage capacity will be low and the catalyst can be deemed to be insufficient to perform its emission reduction function when then oxygen storage capacity is below a threshold. In addition, if the wrong type of catalyst is installed in a vehicle, it may also not meet the threshold oxygen storage capacity, which would also indicate that the catalyst is not function property. Therefore, the present system is configured to send a signal indicating that the oxygen storage capacity is below the threshold, so that corrective action may be taken. For example, the signal may be used actuate a malfunction light, such as a "check engine" light. In addition, or in the alternative, the signal may be used by the vehicle controller to perform other corrective actions, such as limiting the vehicle's fuel supply until the catalyst is replaced and meets the oxygen storage capacity minimum threshold.

Figure 6:
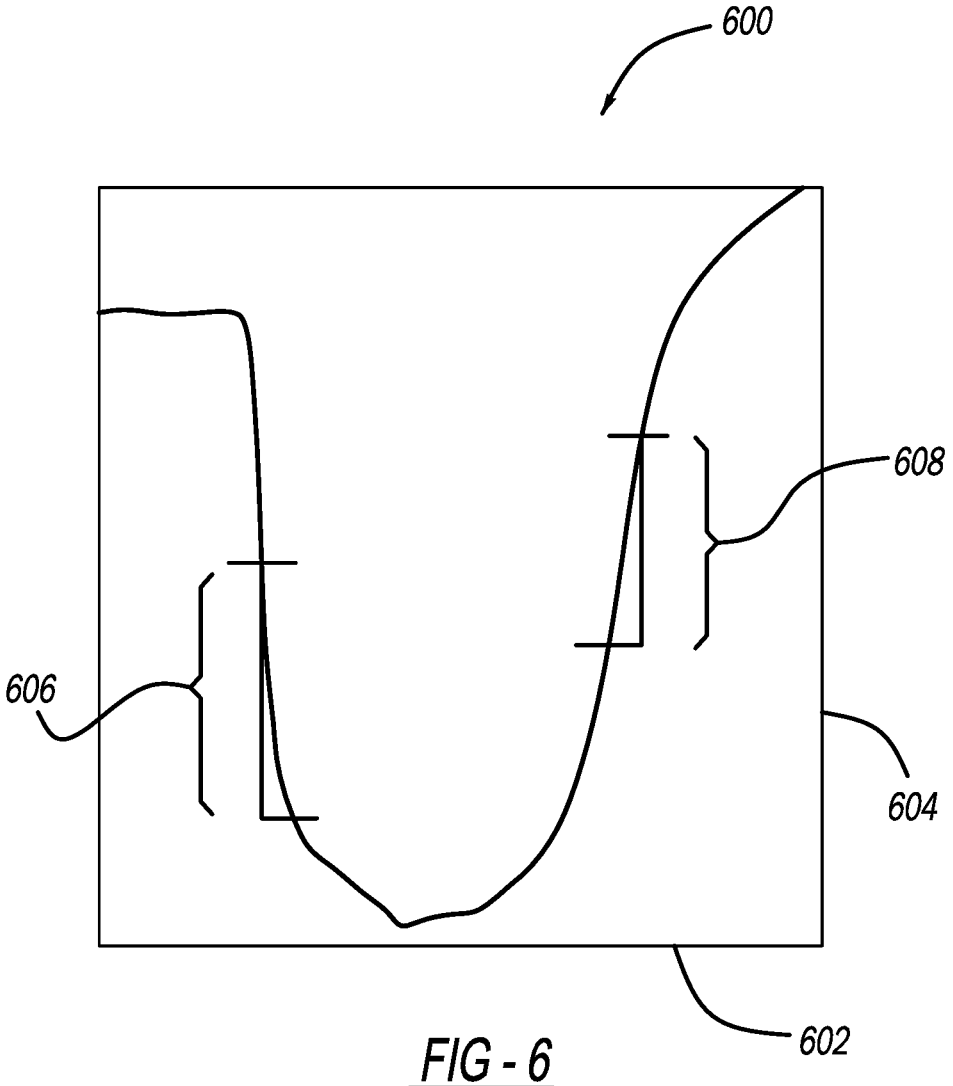
FIG. 6 is a graph illustrating an exemplary response of a switch-type post oxygen sensor.

Referring now to FIG. 6, a graph 600 illustrates the response of a switch-type post lambda sensor. The responsiveness of a switch-type post lambda sensor depends upon the age of the sensors. In general, older sensors have a slower response. The responsiveness may be determined from two calibration tables for engine fueling processes for each of a rich-to-lean transition and a lean-to-rich transition. The horizontal axis 602 of the graph 600 corresponds to time and the vertical axis 604 corresponds to the voltage from the switch-type post lambda sensor. The inputs to the table are integrated values for each of the rich-to-lean transition 606 and the lean-to-rich transition 608. This process may be performed during an engine fuel cut off response, for example, to obtain a sensor response that accounts for the effects of aging on the switch-type post oxygen sensor. In this manner, the actual sensor response which may have changed over time may be determined and may then be used to account for the aging effects on sensor responsiveness in the above-described method and system. This, in turn, provides the ability to improve the estimation of the oxygen storage capacity of the three-way catalyst.

While examples have been described in detail, those familiar with the art to which this disclosure relates will recognize various alternative designs and examples for practicing the disclosed method within the scope of the appended claims.

The following is claimed:

1. An engine system for a vehicle, the engine system comprising:

an internal combustion engine having an exhaust gas outlet;

an exhaust system having a three-way catalyst and a switch-type post oxygen sensor; and an engine control module having a control logic sequence, and wherein the engine control module controls the engine system and the control logic sequence includes:

a first control logic for estimating a three-way catalyst oxygen storage capacity based on a plurality of measured inputs using:

$$\frac{d\delta}{dt} = k^f\left(([CO] + [H_2] - 2[O_2])(1 - \text{abs}(\delta)) - k^b\delta\right);$$

where [CO], [H2], and [O2] are CO, H2, and O2 concentrations at the three-way catalyst outlet and $K^f$ and $K^b$ are calibration constants;

a second control logic for estimating aging effects of the switch-type post oxygen sensor; and a third control logic that calculates a filtered estimated three-way catalyst oxygen storage capacity for the three-way catalyst.

2. The system of claim 1, wherein the control logic sequence further comprises a fourth control logic configured to control the internal combustion engine based upon the filtered estimated three-way catalyst oxygen storage capacity.

3. The system of claim 1, wherein the second control logic estimates aging effects of the switch-type post oxygen sensor using:

$$\tau_\lambda \frac{d\delta_\tau}{dt} = \delta - \delta_\tau.$$

Where $\tau_\lambda$ is switch-type post oxygen sensor dynamic response time.

4. The system of claim 1, wherein the first control logic estimates the three-way catalyst oxygen storage capacity by normalizing using:

$$(-1 \le \delta_\tau \le 1).$$

5. The system of claim 1, wherein the control logic sequence further includes a control logic that determines the switch-type post oxygen sensor dynamic response time by integrating a rich-to-lean and a lean-to-rich response of the switch-type post oxygen sensor.

6. The system of claim 1, wherein the first control logic further determines an estimated switch-type post oxygen sensor voltage using:

$$V_A = f(\delta_\tau);\ (0 \le V_\lambda \le V_{\lambda\text{-}max}).$$

7. The system of claim 1, wherein the plurality of measured inputs include at least one of a pre-catalyst equivalence ratio, a fuel flow rate, exhaust gas pressure, a pre-catalyst exhaust gas temperature, oxygen sensor voltage, a metered mass air flow value, an engine speed value, a catalyst temperature and a fuel control state value.

8. An engine system for a vehicle, the engine system comprising:

an internal combustion engine having an exhaust gas outlet;

an exhaust system having a three-way catalyst and a switch-type post oxygen sensor, and wherein the exhaust system includes an exhaust gas inlet in downstream communication with the exhaust gas outlet of the internal combustion engine; and an engine control module adapted to:

estimate of the oxygen storage capacity of the three-way catalyst based on a plurality of measured inputs using:

$$\frac{d\delta}{dt} = k^f\left(([CO] + [H_2] - 2[O_2])(1 - \mathrm{abs}(\delta)) - k^b\delta\right)$$

where [CO], [H2], and [O2] are CO, H2, and O2 concentrations at the three-way catalyst outlet and $K^f$ and $K^b$ are calibration constants;

estimate a voltage output for the switch-type post oxygen sensor; and correct the estimated oxygen storage capacity based upon a comparison between the estimated voltage output for the switch-type post oxygen sensor and an actual voltage output for the switch-type post oxygen sensor.

9. The system of claim 8, wherein the engine control module is further adapted to control the internal combustion engine based upon the corrected three-way catalyst oxygen storage capacity.

10. The system of claim 8, wherein the engine control module is further adapted estimate aging effects of the switch-type post oxygen sensor using:

$$\tau_\lambda \frac{d\delta_\tau}{dt} = \delta - \delta_\tau,$$

Where $\tau_\lambda$ is switch-type post oxygen sensor dynamic response time.

11. The system of claim 8, wherein the engine control module estimates the oxygen storage of the three-way catalyst by normalizing using:

$$(-1 \le \delta_\tau \le 1).$$

12. The system of claim 8, wherein the engine control module further determines a switch-type post oxygen sensor dynamic response time by integrating a rich-to-lean and a lean-to-rich response of the switch-type post oxygen sensor.

13. The system of claim 8, wherein engine control module estimates the voltage output for the switch-type post oxygen sensor using:

$$V_\lambda = f(\delta_\tau);\ (0 \le V_\lambda \le V_{\lambda\text{-}max}).$$

14. The system of claim 8, wherein the plurality of measured inputs include at least one of a pre-catalyst equivalence ratio, a fuel flow rate, exhaust gas pressure, a pre-catalyst exhaust gas temperature, oxygen sensor voltage, a metered mass air flow value, an engine speed value, a catalyst temperature and a fuel control state value.

15. A method of estimating an oxygen storage capacity of a three-way catalyst in an engine system for a vehicle including an internal combustion engine having an exhaust gas outlet, and an exhaust system having a three-way catalyst and a switch-type post oxygen sensor, the method comprising:

estimating a three-way catalyst oxygen storage capacity based on a plurality of measured inputs using:

$$\frac{d\delta}{dt} = k^f\left(([CO] + [H_2] - 2[O_2])(1 - \mathrm{abs}(\delta)) - k^b\delta\right);$$

where [CO], [H2], and [O2] are CO, H2, and O2 concentrations at the three-way catalyst outlet and $K^f$ and $K^b$ are calibration constants;

estimating aging effects of the switch-type post oxygen sensor; and calculating a filtered estimated three-way catalyst oxygen storage capacity for the three-way catalyst.

16. The method of claim 15, wherein estimating the three-way catalyst oxygen storage capacity further comprises normalizing using:

$$(-1 \le \delta_\tau \le 1).$$

17. The method of claim 15 further comprising controlling the internal combustion engine based upon the filtered estimated three-way catalyst oxygen storage capacity.

18. The method of claim 15 further comprising estimating aging effects of the switch-type post oxygen sensor using:

$$\tau_\lambda \frac{d\delta_\tau}{dt} = \delta - \delta_\tau,$$

Where $\tau_\lambda$ is switch-type post oxygen sensor dynamic response time.

19. The method of claim 15, further comprising determining the switch-type post oxygen sensor dynamic response time by integrating a rich-to-lean and a lean-to-rich response of the switch-type post oxygen sensor.

20. The method of claim 15, further comprising determining an estimated switch-type post oxygen sensor voltage using:

$$V_\lambda = f(\delta_\tau);\ (0 \leq V_\lambda \leq V_{\lambda,max}).$$

* * * * *